US005367155A

United States Patent [19]

Colditz et al.

[11] Patent Number: 5,367,155

[45] Date of Patent: Nov. 22, 1994

[54] X-RAY IMAGE INTENSIFIER TUBE WITH IMPROVED ENTRANCE SECTION

[75] Inventors: Johannes K. E. Colditz, Heerlen; Henricus F. C. Diebels, Eindhoven; Tiemen Poorter, Heerlen; August L. H. Simons, Heerlen; Johnny W. Van Der Velden, Heerlen, all of Netherlands

[73] Assignee: U.S. Philips Corporation, New York, N.Y.

[21] Appl. No.: 959,811

[22] Filed: Oct. 13, 1992

[30] Foreign Application Priority Data

Oct. 10, 1991 [EP] European Pat. Off. ..... 91202628.3

[51] Int. Cl.[5] ..... H01J 31/50

[52] U.S. Cl. ..... 250/214 VT; 313/542

[58] Field of Search ..... 250/214 VT; 313/527, 313/541, 542, 543, 544

[56] References Cited

U.S. PATENT DOCUMENTS 3,716,713 2/1973 Levin ..... 250/214 VT
3,825,763 7/1974 Ligtenberg et al. ..... 250/486
4,712,011 12/1987 Van Leunen ..... 250/361
4,725,724 2/1988 Van Der Velden ..... 313/542
4,820,926 4/1989 Popma et al. ..... 250/486.1
4,831,249 5/1989 Van Der Vekden et al. ..... 250/213
4,967,080 10/1990 Urakami et al. ..... 250/214 VT

FOREIGN PATENT DOCUMENTS 0197597 10/1986 European Pat. Off. .
0265997 5/1988 European Pat. Off. .

*Primary Examiner*—David C. Nelms
*Attorney, Agent, or Firm*—Jack D. Slobod

[57] ABSTRACT

In an X-ray image intensifier tube an entrance section is optimized in respect of image quality, optical aberrations and efficiency. To achieve this, notably in order to avoid photocathode charging phenomena, a separating layer having an adapted electrical transverse conduction is provided. In order to reduce scattered radiation, an edge portion of the entrance screen is deactivated for relevant examinations. In order to increase efficiency, use is made of a double phosphor layer having different X-ray absorption properties. In order to compensate for vignetting a radial variation of the thickness or of the radiation properties of a separating layer or of the luminescent layer itself is used.

18 Claims, 1 Drawing Sheet

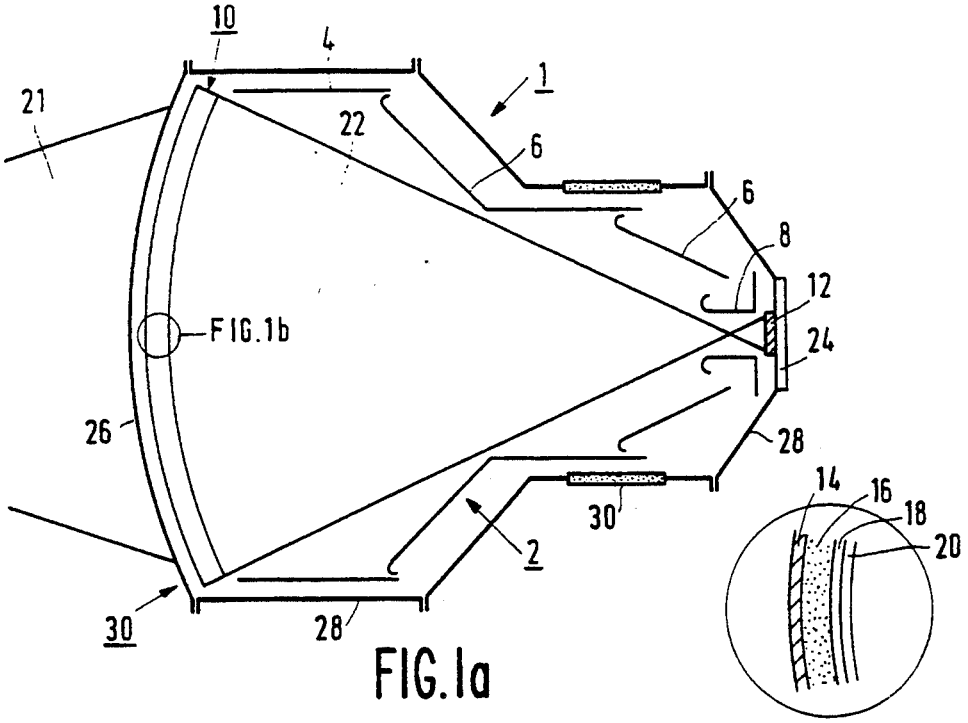
FIG.1a
FIG.1b
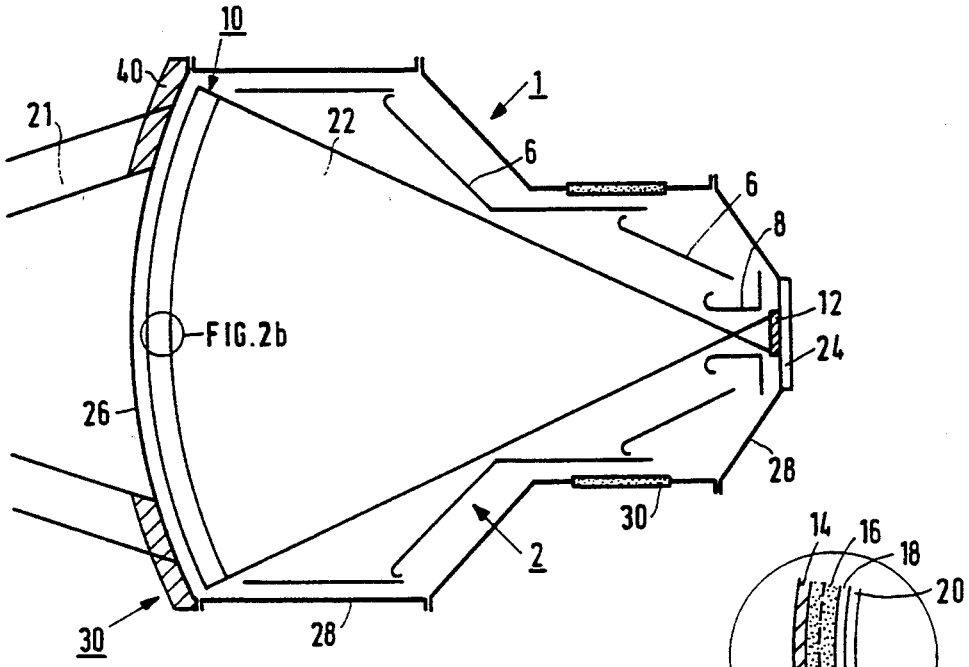
FIG.2a
FIG.2b

X-RAY IMAGE INTENSIFIER TUBE WITH IMPROVED ENTRANCE SECTION

BACKGROUND OF THE INVENTION

1. Field of the Invention

The invention relates to an X-ray image intensifier tube, comprising an entrance section which includes an entrance window and an entrance screen with an entrance luminescent layer, and a photocathode, an exit window and an exit phosphor screen.

2. Description of the Related Art

An X-ray image intensifier tube of this kind is known from U.S. Pat. No. 4,831,249.

In known X-ray image intensifier tubes, having an entrance screen which includes a luminescent layer and a photocathode, improvement of a selected property, for example the efficiency or image information transfer, usually is at the expense of other properties or of at least one other property. For example, a separating layer between the luminescent layer and the photocathode as described in U.S. Pat. No. 4,831,249, can improve the image transfer from the entrance screen, but will also lead to a loss of efficiency as mentioned therein.

It is to be noted that a luminescent screen comprising two different phosphors is known per se from U.S. Pat. No. 4,712,011, but therein the phosphors are mixed or provided in different volume parts, transversely of the layer thickness, so that a loss of resolution is liable to occur. The second layer notably consists of CsI and the first layer consists of a phosphor having a comparatively high absorption for the 35 keV K radiation of the CsI, such as Ca $WO_4$, bismuth germanate or combinations thereof.

SUMMARY OF THE INVENTION

It is an object of the invention to mitigate a plurality of limitations simultaneously; to achieve this, an X-ray image intensifier tube of the kind set forth in accordance with the invention is characterized in that the entrance section integrates a high quantum efficiency with an increased resolution.

An entrance screen of an X-ray image intensifier tube in accordance with the invention combines, for example an increased efficiency and an optimized image information transfer, the latter, for example in respect of resolution, modulation transfer function and reduction of image distortion.

A photocathode is customarily formed by an extremely thin layer so that charging phenomena will readily occur therein, for example at areas where a high photo-electron density occurs (highlights). This effect can occur to an increased degree when a separating layer having a comparatively low electrical conductivity is provided.

In a preferred embodiment, a chemical separating layer is provided between the photocathode and an electrically conductive layer which is situated therebelow, which chemical separating layer substantially increases the service life of the tube without giving rise to image artifacts due to potential excursions on the photocathode as a result of an excessively reduced conductivity between the photocathode and the electrically conductive layer. To this end, the separating layer in a preferred embodiment in accordance with the invention is provided with openings so as to ensure adequate electrical conductivity between the photocathode and an underlying layer, for example the luminescent layer. Chemical interaction between the photocathode and the luminescent layer is still adequately reduced to prevent mutual contamination. The carder for the chemical separating layer can be formed by a separately deposited insulating conductive layer, such as a customarily used $Al_2O_3$ layer, as well as by, for example a top layer of a luminescent material with a dense packing, so that adequate electrical conductivity is ensured thereacross. The luminescent layer notably consists of a comparatively thick structured layer of CsI as described in U.S. Pat. No. 3,825,763 on which there is provided a comparatively thin top layer of CsI as described in U.S. Pat. No. 4,820,926. The openings, however, need not be real openings but may alternatively be formed by locally very thin layer portions, so that at the relevant areas electrical contact is possible, for example via electron tunnelling. Alternatively, adaptation of deposition techniques will enable a conductive layer and the photocathode to extend further into recesses in the luminescent layer than an insulating chemical barrier layer. The holes or openings do not cover more than, for example, 1% of the surface and are preferably distributed reasonably homogeneously across the surface.

A surface of the luminescent layer which is remote from the carrier is mechanically smoothed in a preferred embodiment. This can be achieved, for example by rubbing, grinding or pressing; notably in the case of rolling pressing of the luminescent layer on such a smooth surface, it suffices to use the separating layer as the carrier for the photocathode and the photocathode itself can be deposited uniformly and with an increased electrical conductivity. The image quality can thus be enhanced as a result of lower X-ray absorption of scattering in the separating layer and of improved homogeneity, also as regards layer thickness, of the photocathode.

For example, in the case of vapour-deposition of the luminescent layer, the surface topology may also differ locally, for example it may vary with the radial position on the screen. These differences can also be mitigated by mechanical smoothing, thus improving local homogeneity in the photo-electron beam.

In a preferred embodiment, the homogeneity or a desired variation in the photo-electron beam is adapted by imparting a radially varying thickness to the separating layer. A photo-electron beam which precompensates for vignetting can thus be realized, for example with a current density which increases towards the image periphery. Such a layer can be formed with a high degree of precision in a screen in accordance with the invention notably because of the smooth carrier surface. For the selection of materials for such an intermediate layer, reference is made to U.S. Pat. No. 4,831,249, but known ITO aluminium oxide layers can also be used.

In a further preferred embodiment the local intensity adaptation is realized by utilizing a luminescent layer with a degree of doping which varies radially. As is known, vapour-deposited CsI (Na) is preferably used for an entrance screen of an X-ray image intensifier tube. A radial variation, for example a concentration which increases with the radius, can be comparatively easily imparted to the Na concentration, for example by using adapted vapour deposition techniques. A photo-electron beam exhibiting a current density which increases towards the image periphery can thus again be realized. A substantial advantage is now obtained in that loss of image resolution at the image periphery, due to the known locally thicker construction of the luminescent layer, for example as described in EP 282.089, is now avoided.

In a further preferred embodiment, the X-ray image intensifier tube has an effective entrance surface area which is smaller, due to shielding, than the surface area for which the electron-optical system of the tube is conceived. As a result, improved electron-optical imaging of the photo-electron beam on an exit screen can be realized without any loss of efficiency of the entrance screen. Notably a circular entrance screen is reduced from approximately 25 cm to approximately from 15 to 20 cm. The latter dimension is preferably adapted to a desired exit surface area for specific diagnostic examinations. By abstaining from depositing phosphor outside an effective entrance screen surface thus obtained, it can be ensured, better than in the case of external shielding, that no disturbing scattered radiation is generated at that area.

In a further preferred embodiment, a round entrance screen of, for example 25 cm is reduced to a rectangle of, for example 15×20 cm. The entrance image format can thus be simply adapted to a customary format for, for example a subsequent television chain.

In another preferred embodiment, the entrance luminescent layer comprises two sub-layers, a first sub-layer which is remote from the photocathode exhibiting a comparatively low absorption for medical X-rays (radiation up to, for example 60 keV), but a comparatively high absorption for secondary radiation to be generated in a second layer which is situated near the photocathode. Thus, on the one hand the efficiency is increased because the K radiation from the second layer, preferably consisting of CsI (K edge approximately 35 keV), is at least partly converted in the first layer into luminescent light to be effectively used. On the other hand, the resolution is improved because a comparatively large part of the primary X-rays is converted into luminescent light in the second layer, thus reducing light dispersion.

BRIEF DESCRIPTION OF THE DRAWING

Preferred embodiments in accordance with the invention will be described in detail hereinafter with reference to the drawing. Therein:

FIG. 1*a* shows an X-ray image intensifier tube in accordance with the invention;

FIG. 1*b* shows a blowup of the cross-section of an entrance screen in FIG. 1*a;*

FIG. 2*a* shows such a tube having a reduced entrance screen; and

FIG. 2*b* shows a blowup of the cross-section of the entrance screen in FIG. 2*a.*

DETAILED DESCRIPTION OF THE PREFERRED EMBODIMENTS

An X-ray image intensifier tube 1 as shown in FIG. 1 comprises an electron-optical system 2 which in this case comprises a shielding electrode 4, a focusing electrode 6 and an anode 8. In the tube there are also provided an entrance screen 10 and an exit screen 12. In the present case the entrance screen 10 comprises a carrier 14, a luminescent layer 16, a separating layer 18 and a photocathode 20. Via the electron-optical system 2, an image-carrying photo-electron beam 22 emerging from the photocathode 20 is imaged on the exit screen 12. In the exit screen 12 there is formed a luminescent image which can be studied, photographed, converted into a video signal, etc. via an exit window 24. The tube envelope contains, in addition to the exit window 24, a preferably metal entrance window 26, metal wall portions 28 and an insulating ring 30. The entrance screen is accommodated as a separate component in the tube in the present embodiment, but may alternatively be provided directly on the entrance window 26 instead of on the carrier 14. Separation of vacuum window and substrate for the entrance window offers the advantage that the substrate can be optimized in respect of the electron-optical requirements etc., without it being necessary to take into account the vacuum-atmospheric pressure transition. In a practical case the carrier 14 is formed by an aluminium foil, the luminescent layer 16 is a layer of CsI.Na having a thickness of from approximately 300 to 500 μm, and the photocathode is an S9 or S20 photocathode having a layer thickness of approximately 0.01 μm. The separating layer 18 serves notably to prevent mutual contamination of the luminescent layer and the photocathode and to constitute a suitably defined supporting surface for the comparatively thin photocathode layer.

An entrance section 30 of an X-ray image intensifier tube, assumed to comprise the entrance window 26, the entrance screen 10 with the substrate 14, the luminescent layer 16, the intermediate layer 18, the photocathode 20 and possible additions to the entrance window of the entrance screen in the present embodiment, is required to convert an incident image carrying X-ray beam 21 into a photoelectron beam 22 with a high yield and a high resolution, said photoelectron beam 22 having an optimum geometry and structure for the imaging on the exit screen 12 by the electron-optical system. Negative effects exerted thereon by the separating layer 18 are avoided in the screen shown by depositing this usually electrically insulating layer, for example consisting of $Al_2O_3$, in such a manner, in order to prevent charging phenomena on the photocathode, that adequate electrical conductivity between the photocathode and a carrier for the separating layer, substantially homogeneously across the layer, remains ensured. The carrier for the separating layer can be formed by a top layer of the luminescent layer as well as by an electrically conductive additional layer provided thereon, for example by making the surface of the luminescent layer smoother, or by improved optical matching between the luminescent layer and the photocathode. Adapted sputtering techniques can be applied, for example to ensure that the separating layer covers cavities in the substrate less deeply or that comparatively uniformly distributed openings or thin locations occur across the surface of the separating layer. The occurrence of charging phenomena can thus be avoided, without giving rise to a disturbing reduction of chemical separation.

An X-ray image intensifier tube as shown in FIG. 2 comprises a diaphragm 40 which is exchangeable or not and which ensures that an edge portion of the entrance screen is not exposed to radiation so as to obtain an image which is disturbed less by scattered radiation. This is attractive notably for, for example vascular examinations where an optimum, disturbance-free image of a comparatively small object is desired. The diaphragm 40 forms an active entrance screen having a dimension , $\Phi=15$ to 20 cm from an entrance screen having a dimension $\Phi=25$ cm, or forms a square image (CCD camera) adapted to the video chain or a rectangular image (television pick-up tube) dimensioned, for example $20\times20$ cm$^2$ or, for example $25\times17$ cm$^2$ (monitor image geometry). If the tube is intended exclusively for said specific examination, from a point of view of scattered radiation reduction, a diaphragm is preferably dispensed with and the desired reduced geometry is imparted to the entrance screen itself, i.e. to the luminescent layer and the photocathode. Scattered radiation due to X-ray scattering to the environment or light scattering to the photocathode at that area is also avoided. A gain in efficiency is also achieved by constructing the luminescent layer 16 as a first layer 16-*a* which has a high absorption for secondary X-rays to be generated in its second layer 16-*b*. The first layer then preferably has a comparatively low absorption for the primary X-rays of, for example 60 KeV. The secondary radiation of CsI is approximately 35 KeV.

We claim:

1. An X-ray image intensifier tube comprising an entrance section which includes an entrance window and entrance screen, an exit section which includes an exit window and an exit phosphor screen and an electron-optical system for projecting electrons from said entrance screen to said exit phosphor screen, wherein said exit screen comprises an entrance luminescent layer, a photocathode and a chemical separating layer between the luminescent layer and the photocathode, said separating layer having a electrical conductivity through said separating layer between said carrier layer and said photocathode which varies at different points along the surface area of said separating layer in a manner in order to prevent disturbing charging phenomenon on the photocathode.

2. An X-ray image intensifier tube as claimed in claim 1, characterized in that the separating layer comprises a pattern of holes which are substantially uniformly distributed across the surface.

3. An X-ray image intensifier tube as claimed in claim 1, characterized in that the separating layer exhibits a pattern of thinned portions which are substantially uniformly distributed across the surface and which enable electron tunnelling.

4. An X-ray image intensifier tube as claimed in claim 2, characterized in that a combined surface area of said holes amounts to at the most approximately 1% of the overall surface area of the layer.

5. An X-ray image intensifier tube as claimed in claim 1, characterized in that a carrier layer is formed by a CsI layer of a dense packing.

6. An X-ray image intensifier tube as claimed in claims 1, characterized in that the separating layer consists of sputtered indium tin-oxide and $Al_2O_3$.

7. An X-ray image intensifier as claimed in claim 1, further comprising shielding applied to the entrance window so that an effective entrance screen area is smaller than an area of the entrance screen from which said electron-optical system of the tube has been designed to project electrons to said exit phosphor screen.

8. An X-ray image intensifier tube as claimed in claim 7, characterized in that the shielding consists of a material absorbing X-rays.

9. An X-ray image intensifier tube as claimed in claim 7, characterized in that a round entrance screen having a diameter of approximately 25 cm is reduced to a screen having a diameter of from approximately 15 to 20 cm.

10. An X-ray image intensifier tube as claimed in claim 7, characterized in that said round entrance screen reduced to a rectangular effective screen.

11. An X-ray image intensifier tube as claimed in claim 1, characterized in that the entrance luminescent layer is composed of two sub-layers, a first sub-layer which is remote from the photocathode exhibiting a high absorption for secondary radiation from a second sub-layer situated near the photocathode.

12. An X-ray image intensifier tube as claimed in claim 11, characterized in that the second sub-layer exhibits an absorption for primary X-rays which is higher than that of the first sub-layer.

13. An X-ray image intensifier tube as claimed in claim 11, characterized in that the second sub-layer consists of CsI and the first sub-layer consists of a luminescent material having a high absorption for K-alpha radiation of CsI.

14. An X-ray image intensifier tube as claimed in claim 11, characterized in that the first sub-layer consists of CsI, the second layer being chosen from Ca $WO_4$ and bismuth germanate or compositions thereof.

15. An X-ray image intensifier tube as claimed in claim 1, characterized in that the chemical separating layer has a thickness which varies with a radius of position along the entrance screen.

16. An X-ray image intensifier tube as claimed in claim 1, characterized in that the luminescent layer has a doping concentration which varies with the radius of position along the entrance screen.

17. An X-ray intensifier tube as claimed in claim 3 characterized in that a combined surface area of the thinned portions amounts to at most 1% of the overall surface area of the layer.

18. An X-ray intensifier tube as claimed in claim 1, characterized in that the chemical separating layer has an electrical transverse conduction which varies with a radius of position along the entrance screen.

* * * * *